US009970321B2

(12) United States Patent
Nguyenloc et al.

(10) Patent No.: US 9,970,321 B2
(45) Date of Patent: May 15, 2018

(54) HOUSING SUPPORT NUT CONNECTION

(71) Applicant: UNITED TECHNOLOGIES CORPORATION, Farmington, CT (US)

(72) Inventors: Fred Nguyenloc, Plainville, CT (US); Leslie C. Kurz, Hebron, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 602 days.

(21) Appl. No.: 14/552,176

(22) Filed: Nov. 24, 2014

(65) Prior Publication Data

US 2016/0177783 A1 Jun. 23, 2016

Related U.S. Application Data

(60) Provisional application No. 61/914,050, filed on Dec. 10, 2013.

(51) Int. Cl.
*F01D 25/16* (2006.01)
*F01D 25/24* (2006.01)

(52) U.S. Cl.
CPC ..... *F01D 25/162* (2013.01); *F01D 25/243* (2013.01)

(58) Field of Classification Search
CPC .... F01D 25/24; F01D 25/243; F05D 2220/32; F05D 2240/60; Y10T 403/64; Y10T 403/642; Y10T 403/648; F16L 19/005; F16L 19/02; F16L 19/0206; F16L 19/0218; F16L 23/036
See application file for complete search history.

(56) References Cited

U.S. PATENT DOCUMENTS 1,016,620 A * 2/1912 Gapp ..... F16L 19/0206 285/148.19
2,804,323 A * 8/1957 Morley ..... F01D 5/025 403/194
2,880,019 A * 3/1959 Wurtz ..... F16L 19/0212 277/627
3,970,398 A * 7/1976 Wilson ..... F01D 5/026 403/13
4,765,145 A * 8/1988 Hines ..... F16L 19/005 285/317
4,856,273 A * 8/1989 Murray ..... F01M 11/06 184/6.11
7,331,612 B2 * 2/2008 Frost ..... F16L 19/02 277/644
7,547,049 B2 * 6/2009 Gashgaee ..... F04B 53/16 285/124.5
2010/0027930 A1 * 2/2010 Kinnaird ..... F01D 25/164 384/523

* cited by examiner

*Primary Examiner* — Michael P Ferguson
(74) *Attorney, Agent, or Firm* — Cantor Colburn LLP

(57) ABSTRACT

A housing connection includes a first housing defining a first housing compartment with a first set of threads defined circumferentially around the first housing. A second housing defines a second housing compartment therein. The second housing includes an engagement tab configured for engagement with the first housing. A retention nut defines a second set of threads circumferentially around the retention nut. The first and second sets of threads are engaged together and clamp the engagement tab of the second housing between the first housing and the retention nut ring.

16 Claims, 4 Drawing Sheets

HOUSING SUPPORT NUT CONNECTION

CROSS-REFERENCE TO RELATED APPLICATION

This application claims the benefit of priority under 35 U.S.C. § 119(e) to U.S. Provisional Application No. 61/914,050, filed Dec. 10, 2013, which is incorporated herein by reference in its entirety.

STATEMENT REGARDING FEDERALLY SPONSORED RESEARCH OR DEVELOPMENT

This invention was made with government support under contract number 5148262-0302-0343 awarded by the United States Army. The government has certain rights in the invention.

BACKGROUND OF THE INVENTION

1. Field of the Invention

The present disclosure relates to housing connections, and more particularly to housing connections for aerospace applications such as in gas turbine engines.

2. Description of Related Art

Traditional housings within gas turbine engines are bolted together. For example, forward and aft bearing housings can be bolted together with a circumferential series of bolts. In some applications space is provided between circumferentially adjacent bolts for pins and jumper tubes or other passages to pass through a bulkhead of each of the two housings to allow for passage of fluids such as air and oil. In designs where the bolts joining the housings and the jumper tubes occupy the same circumferential region of the interface between the two housings, design flexibility can be limited by the space needed for the jumper tubes, pins, and bolts.

Such conventional methods and systems have generally been considered satisfactory for their intended purpose. However, there is still a need in the art for improved housing connections. The present disclosure provides a solution for this need.

SUMMARY OF THE INVENTION

A housing connection includes a first housing defining a first housing compartment with a first set of threads defined circumferentially around the first housing. A second housing defines a second housing compartment therein. The second housing includes an engagement tab configured for engagement with the first housing. A retention nut defines a second set of threads circumferentially around the retention nut. The first and second sets of threads are engaged together and clamp the engagement tab of the second housing between the first housing and the retention nut ring.

In certain embodiments, a plurality of windows placing the first housing compartment in fluid communication with the second housing compartment is defined through the first and second housings. The windows can be substantially evenly spaced apart from one another circumferentially.

A plurality of passages can be defined through the first and second housings for fluid communication between the first housing compartment and the second housing compartment. The plurality of passages can include at least one of an oil supply passage, an air supply passage, a forward scavenge passage, a vent passage, and an aft scavenge passage. The passages can be defined inboard of the retention nut. It is also contemplated that at least one of the passages can be defined through a jumper tube, e.g., an o-ring jumper tube or the like, connecting the first and second housings.

In another aspect, an anti-rotation washer can be engaged with the retention nut and with the first housing for retaining threaded engagement of the first and second sets of threads. The anti-rotation washer can include a plurality of circumferentially spaced housing tabs engaged with a plurality of circumferentially spaced retention tabs of the first housing. The anti-rotation washer can include a plurality of circumferentially spaced nut tabs engaged with a plurality of circumferentially spaced retention tabs of the retention nut. The housing tabs, nut tabs, and retention tabs can be engaged to prevent unthreading of the first and second sets of threads. A retention ring can be engaged with the anti-rotation washer and at least one of the housing and nut tabs for retaining the anti-rotation washer in place. Those skilled in the art will readily appreciate that any other suitable methods of anti-rotation can be used, such as Vespel® inserts or riveting the retention nut (Vespel® polyimide products are available from E.I. du Pont de Nemours and Company of Wilmington, Del.). It is also contemplated that a seal such as a c-seal, o-ring, gasket, metallic seal, or the like, can be sealingly engaged with the first and second housings.

In another aspect, a gas turbine engine includes a first housing as described above used as a first bearing housing defining a first bearing compartment, a second housing as described above used as a second bearing housing defining a second bearing compartment therein, and a retention nut as described above in the form of a retention nut ring. The first and second bearing housings and the retention nut ring can circumferentially surround a rotary shaft.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
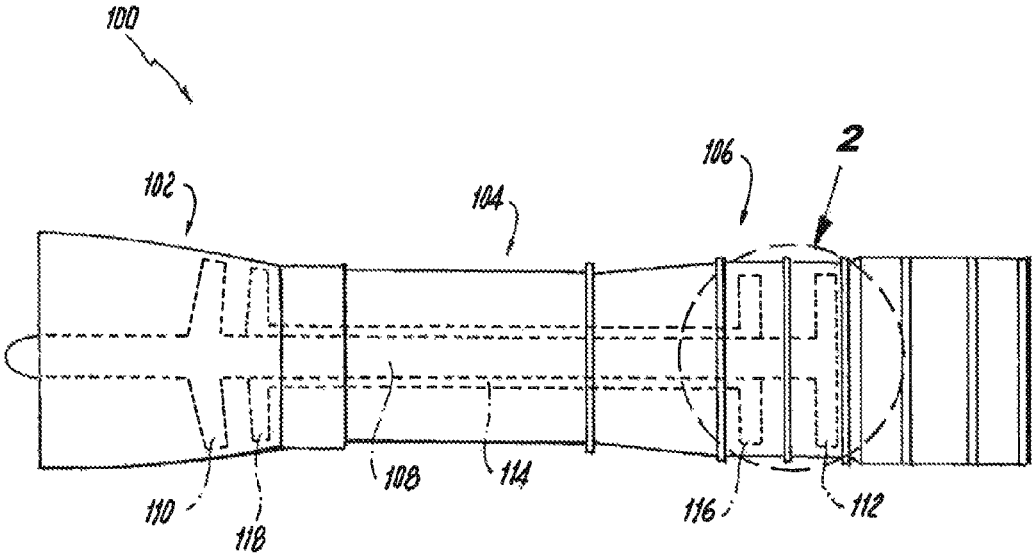
FIG. 1 is a schematic side elevation view of an exemplary embodiment of a gas turbine engine constructed in accordance with the present disclosure.

Reference will now be made to the drawings wherein like reference numerals identify similar structural features or aspects of the subject disclosure. For purposes of explanation and illustration, and not limitation, a partial view of an exemplary embodiment of a gas turbine engine in accordance with the disclosure is shown in FIG. 1 and is designated generally by reference character 100. Other embodiments in accordance with the disclosure, or aspects thereof, are provided in FIGS. 2-7, as will be described. The systems and methods described herein can be used to improve housing connections, for example in bearing housings of gas turbine engines.

Gas turbine engine 100 includes a compressor 102 for compressing air, a combustor 104 for heating the air, and a turbine 106 for extracting work from the heated air. A first shaft 108 connects a low pressure compressor rotor 110 to a low pressure turbine rotor 112 for common rotation, and a second shaft 114, mounted concentric with shaft 108, connects a high pressure turbine rotor 116 to a high pressure compressor rotor 118 for common rotation. Other aspects of engine 100 not discussed herein will be readily appreciated by those skilled in the art including engines with a third shaft for power extraction, for example.

Figure 2:
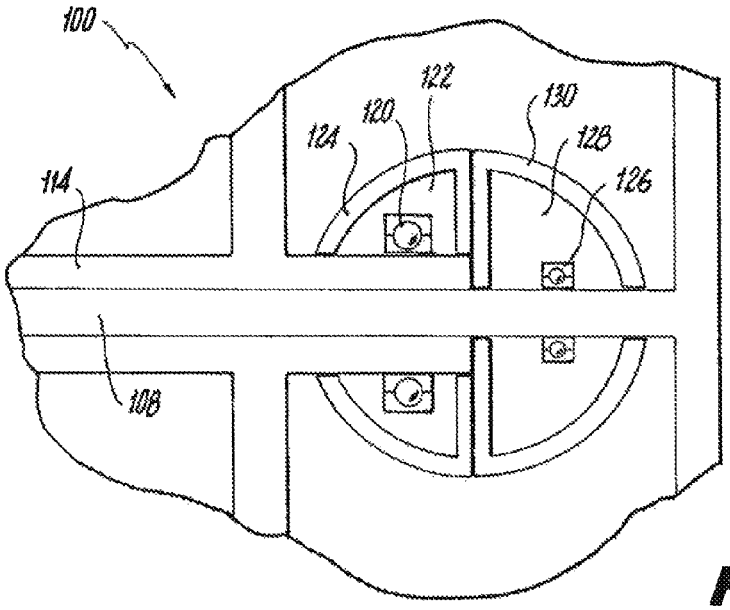
FIG. 2 is a schematic side elevation view of a portion of the engine of FIG. 1, showing the forward and aft bearing compartments.

Referring now to FIG. 2, shaft 114 is supported by a first bearing 120 within a housing compartment 122, e.g., a forward bearing housing compartment. Housing compartment 122 is enclosed by a housing 124, e.g., a forward bearing housing. Shaft 108 is supported by a second bearing 126 within a housing compartment 128, e.g., an aft bearing housing compartment. Housing compartment 128 is enclosed by housing 130, e.g., an aft bearing housing.

Figure 3:
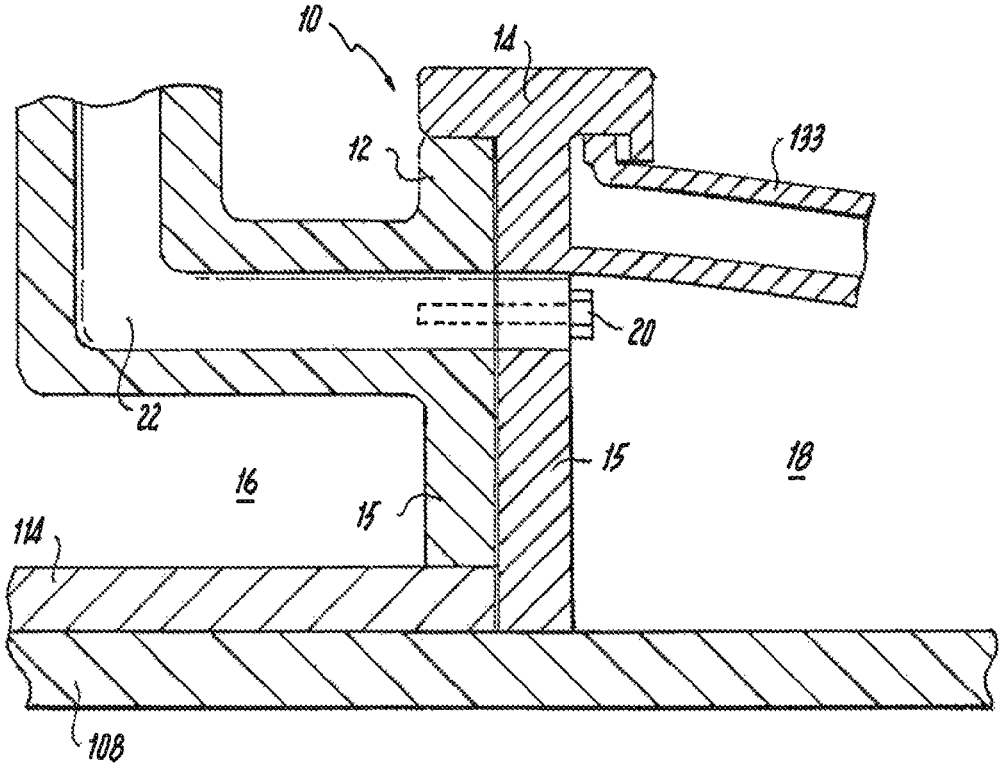
FIG. 3 is a schematic side elevation view of a portion of a forward and aft bearing compartment with a jumper tube passing from the forward bearing compartment to the aft bearing compartment.
Figure 4:
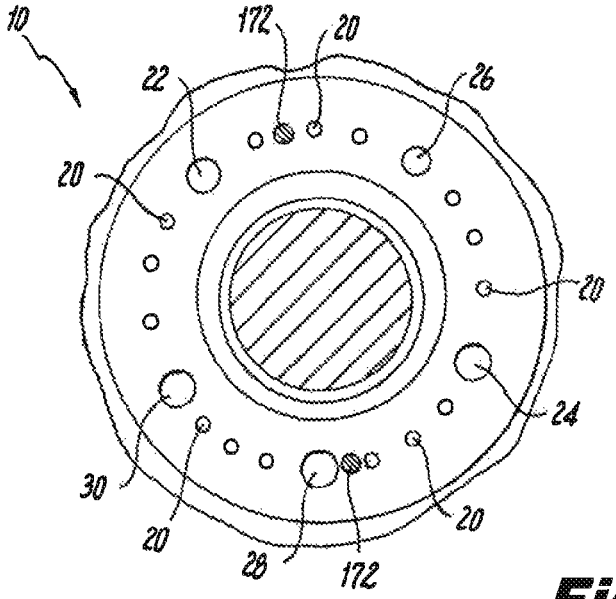
FIG. 4 is a schematic axial elevation view of the interface between the forward and aft bearing compartments of FIG. 3, showing the circumferential arrangement of bolts and passages from the forward bearing compartment to the aft bearing compartment.

Referring now to FIGS. 3-4, a housing connection 10 is described. Housing connection 10 connects between a forward housing 12 and an aft housing 14, which define respective forward housing compartment 16 and aft housing compartment 18 therein. A set of bolts 20, one of which is depicted in FIG. 3, but see also FIG. 4, fasten forward housing 12 and aft housing 14 together. A plurality of passages are formed through the bulkheads 15 of the forward and aft housings 12 and 14. As depicted schematically in FIG. 4, the plurality of passages includes an air supply passage 22, a forward scavenge passage 24, a vent passage 26, an aft scavenge passage 28, and an oil supply passage 30. These passages may be circumferentially spaced evenly, and in between each circumferentially adjacent pair of the passages 22, 24, 26, and 28 there are a number of circumferentially spaced bolts 20. There are also a number of circumferentially spaced pins 172. One or more pins 172 properly align the two housing compartments and prevent relative circumferential motion.

Due to the fact that the bolts 20 and passages 22, 24, 26, and 28 all occupy the same circumferential region of the interface between the forward and aft housings 12 and 14, this configuration can limit design flexibility in certain applications. For example, if it is desired to reduce the overall diameter of the forward and aft housings 12 and 14, increase the number or size of passages, or the like, having the bolts 20 and passages 22, 24, 26, and 28, and pins 172 occupy the same circumferential region can pose limitations on the extent of such design changes.

Figure 5:
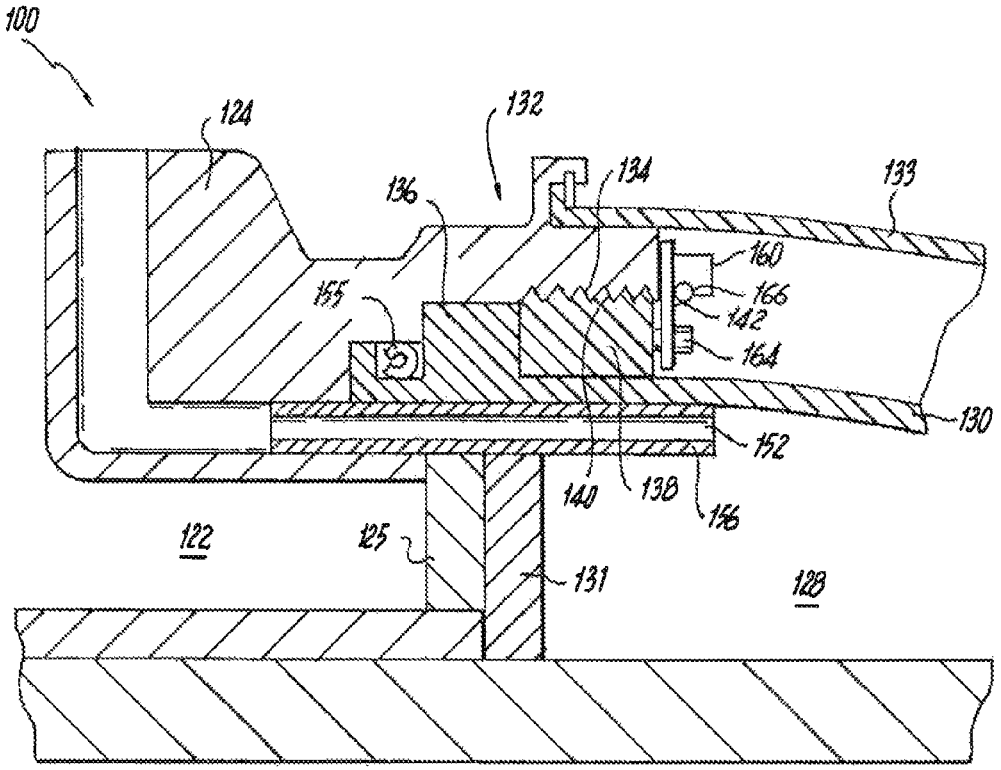
FIG. 5 is a schematic side elevation view of an exemplary embodiment of a housing connection constructed in accordance with the present disclosure, showing first and second bearing housings joined together with a retention nut.
Figure 6:
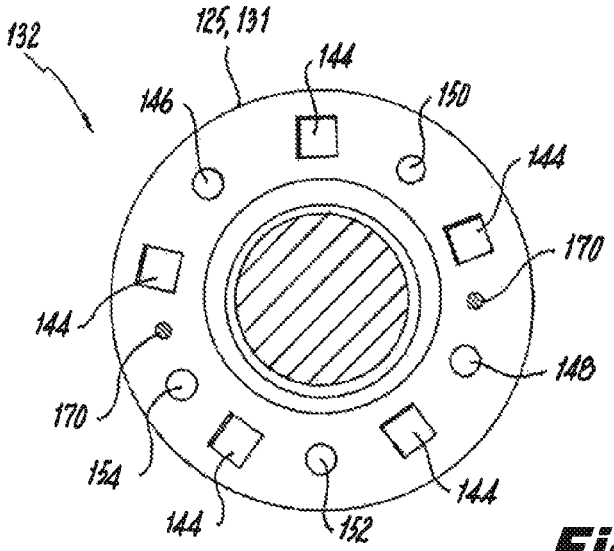
FIG. 6 is a schematic axial elevation view of the interface of the forward and aft bearing housings of FIG. 5, showing the arrangement of passages and windows through the interface.

Referring now to FIGS. 5-6, engine 100 is described in greater detail, and in particular housing connection 132 connecting housing 124 and housing 130 together is described. Housing connection 132 includes housing 124, which includes a first set of threads 134 defined circumferentially around the housing 124. Housing 130 includes an engagement tab 136 configured for engagement with housing 124. A retention nut 138 defines a second set of threads 140 circumferentially around retention nut 138. The first and second sets of threads 134 and 140 are engaged together with the engagement tab 136 of housing 130 engaged between the housing 124 and retention nut ring 138. Housings 124 and 130 and the retention nut ring 138 can circumferentially surround rotary shafts 108 and 114. An anti-rotation washer 142 is engaged with housings 124 and 130 to prevent unthreading of threads 134 and 140, as described in further detail below with reference to FIG. 7. Bulkhead 125 of housing 124 and bulkhead 131 of housing 130 divide housing compartment 128 from housing compartment 122. A heat shield 133 is mounted to housing 124 outboard of housing 130 to thermally isolate hosing compartment 128 from the engine components radially outboard thereof.

With reference to the schematic view of housing connection 132 in FIG. 6, a plurality of windows 144 are defined through the bulkheads 125 and 131 placing the housing compartments 122 and 128 in fluid communication with one another. This can alleviate or prevent buildup of pressure differentials between the housing compartments 122 and 128. The windows 144 may be evenly spaced apart from one another circumferentially. Passages 146, 148, 150, 152, and 154, similar to passages 22, 24, 26, 28, and 30 of FIG. 4, respectively, are also defined through the bulkheads 125 and 131 of housings 124 and 130 for fluid communication between housing compartments 122 and 128. Passages 146, 148, 150, 152, and 154 are defined inboard of the retention nut 138 shown in FIG. 5. One or more circumferentially placed pins 170 properly align the two housing compartments and prevent relative circumferential motion. The pins 170 can optionally be replaced with one or more tabs. As shown in FIG. 5, passage 152 is defined through a jumper tube 156 connected to at least one of the housings 124 and 130. Those skilled in the art will readily appreciate that jumper tube 156 is optional, that similar jumper tubes can optionally be included in any of the other passages 146, 148, 150, and 154, and that the jumper tube 156 can be sealed with an o-ring jumper tube connection. A seal 155 is sealingly engaged with housings 124 and 130 for preventing fluids such as air and oil from escaping outside of the housing compartments interface. Seal 155 can be of any suitable type such as a c-seal, o-ring, gasket, metallic seal, or the like. Due to the fact that there are no bolts, e.g., bolts 20 of FIG. 4, sharing the same circumferential region as windows 144 and passages 146, 148, 150, 152, and 154, greater design flexibility is achieved with respect to the overall diameter of housing connection 132, the size and number of passages and windows, and the like, when compared to the configuration shown in FIG. 4. While shown and described with exemplary numbers and types of passages and windows, those skilled in the art will readily appreciate that any other suitable numbers and types of passages and windows can be used without departing from the scope of this disclosure. Any suitable window shapes can be used, and the windows need not necessarily be spaced evenly circumferentially.

Figure 7:
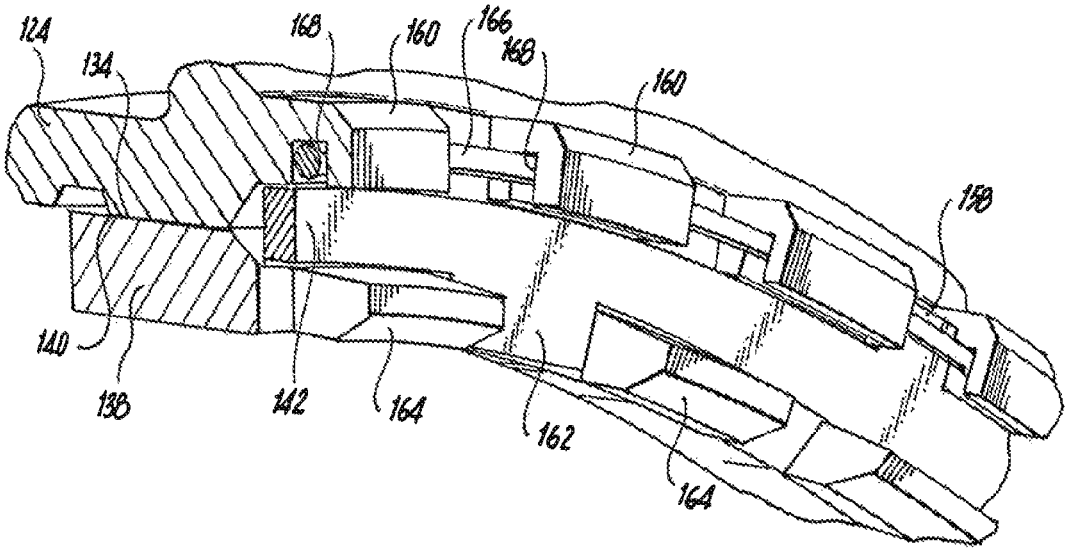
FIG. 7 is a schematic cross-sectional perspective view of a portion of the housing connection of FIG. 5, showing the anti-rotation washer.

Referring now to FIG. 7, anti-rotation washer 142 is engaged with the retention nut 138 and with housing 124 for retaining threaded engagement of the threads 134 and 140. Anti-rotation washer 142 includes a plurality of circumferentially spaced housing tabs 158 extending radially outward and engaged with a plurality of circumferentially spaced retention tabs 160 of housing 124. Anti-rotation washer 142 also includes a plurality of circumferentially spaced nut tabs 162 extending radially inward and engaged with a plurality of circumferentially spaced retention tabs 164 of retention nut 138. The housing tabs 158, nut tabs 162, and retention tabs 160 and 164 are engaged to prevent unthreading of threads 134 and 140. A retention ring 166, e.g., a snap ring, is engaged with the anti-rotation washer 142 housing and retention tabs 160 for retaining the anti-rotation washer 142 in place axially. Retention ring 166 seats in slots 168 of retention tabs 160, which have a large enough outer diameter to allow retention ring 166 to clear housing tabs 158 radially as anti-rotation washer 142 is placed. Those skilled in the art will readily appreciate that retention ring 166 could instead be configured to seat in slots within retention tabs 164. Those skilled in the art will readily appreciate that any other suitable anti-rotation device can used in addition to or in lieu of anti-rotation washer 142, such as Vespel® inserts or riveting the retention nut (Vespel® polyimide products are available from E.I. du Pont de Nemours and Company of Wilmington, Del.).

An exemplary configuration is described above having a tab for a single housing, e.g., engagement tab 136 of housing 130, clamped by threaded engagement, e.g., clamped by retention nut 138. Those skilled in the art will readily appreciate that additional tabs supporting other compartments and/or components can be clamped by the threaded engagement without departing from the scope of this disclosure.

The methods and systems of the present disclosure, as described above and shown in the drawings, provide for housing connections with superior properties including improved flexibility in positioning and dimensioning passages through the housings. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A housing connection of a gas turbine engine, comprising:

a first housing, the first housing comprising a first annular housing wall defining a compartment and having a first annular flange disposed at an end thereof defining an abutment shoulder and having a first set of threads defined circumferentially around an inner surface of the flange of the first housing;

a second housing, the second housing comprising a second annular housing wall defining a compartment and having a second annular flange disposed at an end thereof defining an outwardly-extending engagement tab;

a retention nut disposed on an outer surface of the second housing wall and having a second set of threads disposed circumferentially around an outer surface of the retention nut, wherein the retention nut clamps the engagement tab of the second housing to the abutment shoulder of the first housing when the first set of threads of the first housing engages the second sets of threads of the retention nut;

a plurality of windows circumferentially arranged on a bulkhead concentrically disposed within the first housing adjacent the first flange; and a plurality of windows circumferentially arranged on a bulkhead concentrically disposed within the second housing adjacent the second flange, wherein the plurality of windows of the bulkhead of the first housing and the plurality of windows of the bulkhead of the second housing are aligned with each other to define a plurality of fluid passages between the compartment of the first housing and the compartment of the second housing.

2. A housing connection as recited in claim 1, wherein the windows of the bulkhead of the first housing and the plurality of windows of the bulkhead of the second housing are substantially evenly spaced apart from one another circumferentially.

3. A housing connection as recited in claim 1, further comprising an anti-rotation device engaged with the retention nut and with the first housing for retaining threaded engagement of the first set of threads and the second sets of threads.

4. A housing connection as recited in claim 1, wherein there are no bolts sharing a circumferential region where the plurality of windows of the bulkhead of the first housing and the plurality of windows of the bulkhead of the second housing are located.

5. A housing connection as recited in claim 4, wherein the plurality of passages includes at least one of an oil supply passage, an air supply passage, a forward scavenge passage, a vent passage, and an aft scavenge passage.

6. A housing connection as recited in claim 4, wherein the plurality of passages are defined located within a periphery defined by inboard of the retention nut.

7. A housing connection as recited in claim 4, wherein at least one of the plurality of passages comprises a jumper tube.

8. A housing connection as recited in claim 1, further comprising a seal sealingly engaged between the first housing and the second housing.

9. A gas turbine engine, comprising:

a first bearing housing, the first bearing housing comprising a first annular housing wall defining a compartment and having a first annular flange disposed at an end thereof defining an abutment shoulder and having a first set of threads defined circumferentially around an inner surface of the flange of the first bearing housing;

a second bearing housing, the second bearing housing comprising a second annular housing wall defining a compartment and having a second annular flange disposed at an end thereof defining an outwardly-extending engagement tab;

a retention nut ring disposed on an outer surface of the second housing wall and having a second set of threads disposed circumferentially around an outer surface of the retention nut ring, wherein the nut ring clamps the engagement tab of the second bearing housing to the abutment shoulder of the first bearing housing when the first set of threads engages the second set of threads;

a plurality of windows circumferentially arranged on a bulkhead concentrically disposed within the first bearing housing adjacent the first flange; and a plurality of windows circumferentially arranged on a bulkhead concentrically disposed within the second bearing housing adjacent the second flange wherein the plurality of windows of the bulkhead of the first bearing housing and the plurality of windows of the bulkhead of the second bearing housing are aligned with each other to define a plurality of fluid passages between the compartment of the first bearing housing and the compartment of the second bearing housing.

10. A gas turbine engine as recited in claim 9, wherein the first bearing housing and the second bearing housing and the retention nut ring circumferentially surround a rotary shaft.

11. A gas turbine engine as recited in claim 9, wherein the plurality of windows on the bulkhead of the second bearing housing and the plurality of windows on the bulkhead of the first bearing housing are substantially evenly spaced apart from one another circumferentially.

12. A gas turbine engine as recited in claim 9, further comprising an anti-rotation washer engaged with the retention nut ring and with the first bearing housing for retaining threaded engagement of the first set of threads and the second sets of threads.

13. A gas turbine engine as recited in claim 9, wherein the plurality of passages includes at least one of an oil supply passage, an air supply passage, a forward scavenge passage, a vent passage, and an aft scavenge passage.

14. A gas turbine engine as recited in claim 13, wherein at least one of the passages comprises a jumper tube.

15. A gas turbine engine as recited in claim 9, further comprising a seal sealingly engaged between the first bearing housing and the second bearing housing.

16. A gas turbine engine as in claim 9, wherein there are no bolts sharing a circumferential region where the plurality windows of the bulkhead of the first bearing housing and the plurality of windows of the bulkhead of the second bearing housing are located.

* * * * *